United States Patent [19]

Fritts et al.

[11] Patent Number: 5,007,212

[45] Date of Patent: Apr. 16, 1991

[54] INFLATABLE SHELTER

[76] Inventors: Monty Fritts, 1006 S. Elm; Darren J. Myers, Rt. 4, Box 99, both of Ottawa, Kans. 66067

[21] Appl. No.: 496,870

[22] Filed: Mar. 21, 1990

[51] Int. Cl.[5] ..... E04H 15/00

[52] U.S. Cl. ..... 52/2.18; 52/2.23; 135/116

[58] Field of Search ..... 52/2 K, 2 J, 2 H; 135/116

[56] References Cited

U.S. PATENT DOCUMENTS

| | | | |
|---|---|---|---|
| 1,964,818 | 7/1934 | Hood | 52/2 K |
| 2,754,836 | 7/1956 | Darby | 52/2 K |
| 2,875,711 | 3/1959 | Brewin | 52/2 K |
| 2,895,490 | 7/1959 | Dimond | 52/2 K |
| 3,145,719 | 8/1964 | Johnson | 52/2 K |
| 3,227,169 | 1/1966 | Fischer . | |
| 3,456,403 | 7/1969 | Batterson | 52/2 J |
| 3,999,333 | 12/1976 | Amarantos | 52/2 J |
| 4,000,585 | 1/1977 | Denaro . | |
| 4,384,435 | 5/1983 | Polise et al. | 52/2 J |
| 4,629,433 | 12/1986 | Magid | 52/2 J X |
| 4,766,918 | 8/1988 | Odekirk . | |

*Primary Examiner*—David A. Scherbel
*Assistant Examiner*—Linda J. Watson
*Attorney, Agent, or Firm*—Litman, McMahon & Brown

[57] ABSTRACT

A temporary shelter having an inflatable, tubular base frame with inflatable, tubular wall support ribs fixedly attached thereto, the ribs converging to near an apex of the shelter. Flexible, water-resistant wall portions are fixedly attached to the tubular base and wall support ribs. The base frame, wall support ribs and wall covering form a domed structure when the base frame and support ribs are inflated.

2 Claims, 2 Drawing Sheets

INFLATABLE SHELTER

BACKGROUND OF THE INVENTION

1. Field of the Invention.

The present invention relates to temporary shelters and, in particular, to an inflatable shelter having a tubular inflatable base frame and wall supports forming a dome tent when inflated.

2. Description of the Prior Art

Tents and other temporary shelters for out-of-door use by recreational campers, back-packers, hunters and others are usually made from lightweight, water-resistant materials. The tents are often of one piece construction with the exception of the poles, rods or other supports used to support the tent walls. Although the tent supports may be lightweight, they are often awkward to carry. If the tent supports are broken down into smaller pieces, they may be easier to carry but are more likely to be lost or misplaced.

The prior art teaches inflatable tents utilizing air ducts to support the tent walls, eliminating the need for poles, rods or other conventional wall supports. However, such tents are often unstable in windy and other adverse weather conditions because they lack adequate support, particularly near their bases. Some prior art tents are anchored to the ground by stakes or other fastening devices located along the bases of the tent walls. Tents have also been attached to rigid frames in order to maintain acceptable angles between the tent walls and the ground for maximum strength and water drainage. A rigid frame poses the same problems of awkward handling and potential loss of component pieces, as do conventional tent supports such as rods or poles. Anchoring a tent to the ground at a plurality of locations is a labor-intensive activity. Time and effort must also be taken to insure that the walls of the tent are properly positioned.

SUMMARY OF THE INVENTION

The inflatable shelter of this invention includes an annular, tubular base portion that forms a circular or eliptical base frame when inflated with air. Tubular, inflatable support ribs are fixedly attached to the base frame and converge at an apex centered above the base of the shelter. The base frame and support ribs are made from a puncture and water-resistant plastic material. Flexible, water-resistant wall portions are sewn, heat-sealed or otherwise attached to the support ribs. Fenestration such as a door and windows are included in the wall portions. When filled with air, the base frame and support ribs form a semi-rigid structure that automatically places the wall portions in position, forming a domed shelter.

In a first embodiment of the present invention, the base frame and support ribs are fluidically connected for inflating and deflating the entire structure by means of a single air valve. In a second embodiment, the base frame and support ribs are fixedly attached to each other as in the first embodiment, but the base frame and each support rib are fluidically separated, each having a discrete air chamber and an air valve, thus guarding against collapse of the entire structure if the base frame or a rib is punctured.

The shelter may include a flexible, water-resistant floor, fixedly attached to the base frame. An inflatable mattress may be included, either attached or detached from the base frame and floor.

OBJECTS OF THE INVENTION

Therefore, the objects of the present invention are: to provide a temporary shelter and, in particular, an inflatable shelter that is lightweight, water-resistant and of single-piece construction; to provide such an inflatable shelter that folds to a compact form for storage and transport; to provide such a shelter that is easy to erect; to provide such a shelter that can be erected quickly utilizing minimal labor by inflating the base frame and wall support ribs; to provide such a shelter that, when inflated, forms a semi-rigid, stable structure for out-of-door use; to further provide such a shelter that is made from a strong, puncture-resistant material; to provide such a shelter having a shape that allows for adequate water drainage off the shelter walls; to provide such a shelter that may be constructed in a variety of sizes; to provide such a shelter adaptable for a variety of uses; to provide such a shelter adaptable for uses such as a tent for recreational camping, portable greenhouse, plant cover for frost protection, emergency shelter and a hunter's blind; to provide such an inflatable shelter that is relatively easy to use, inexpensive to construct and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
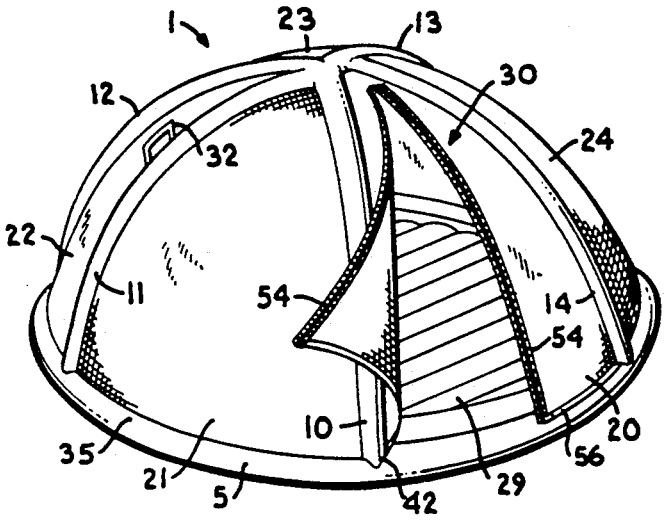
FIG. 1 is a perspective view of an embodiment of an inflatable shelter in accordance with the present invention, including an inflatable base frame and five inflatable wall support ribs.
Figure 3:
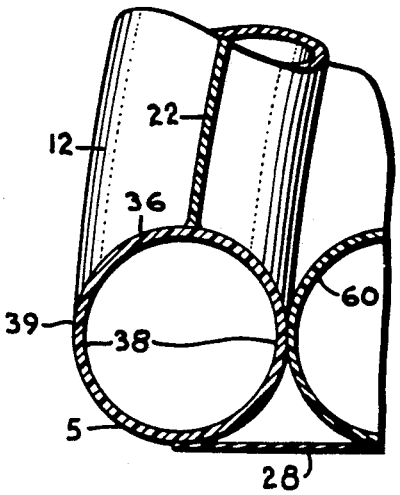
FIG. 3 is is an enlarged, fragmentary, cross-sectional view of the inflatable shelter taken along line 3—3 of FIG. 2.
Figure 2:
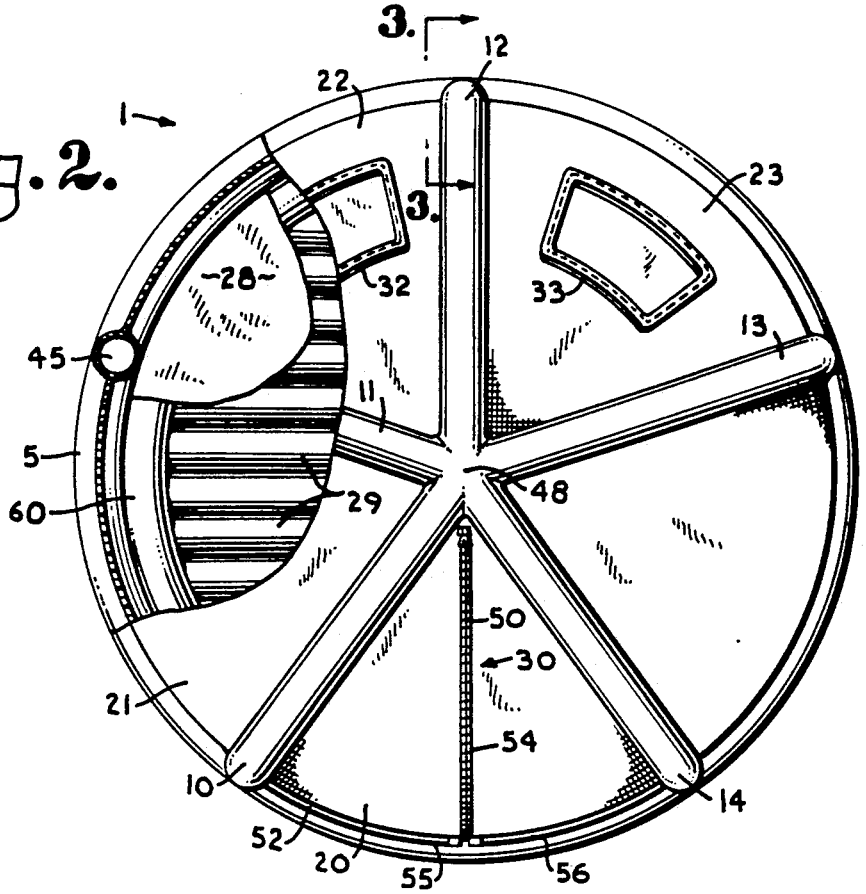
FIG. 2 is an enlarged, top plan view of the inflatable shelter with portions broken away to show detail thereof.
Figure 4:
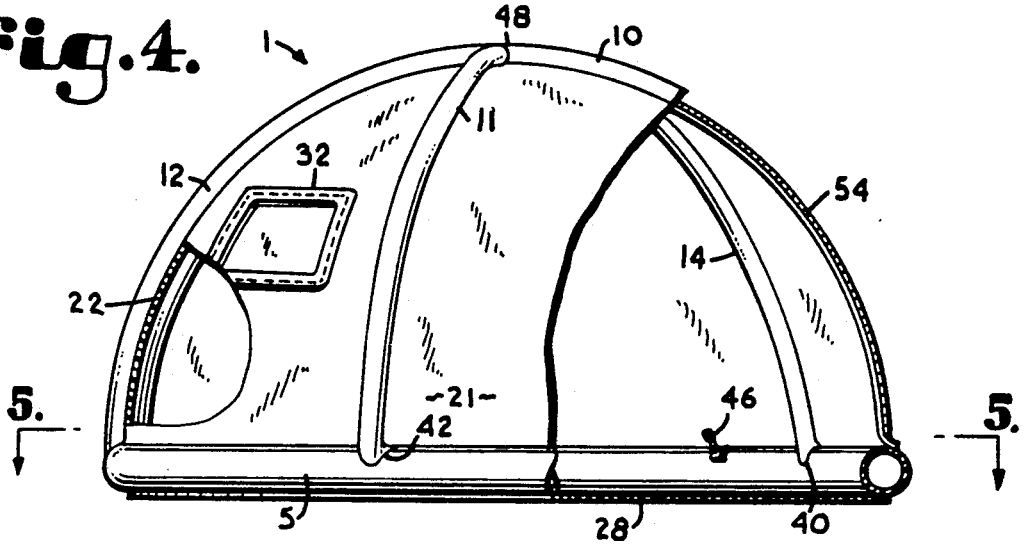
FIG. 4 is an enlarged, front elevational view of the inflatable shelter with portions broken away to show detail thereof.
Figure 5:
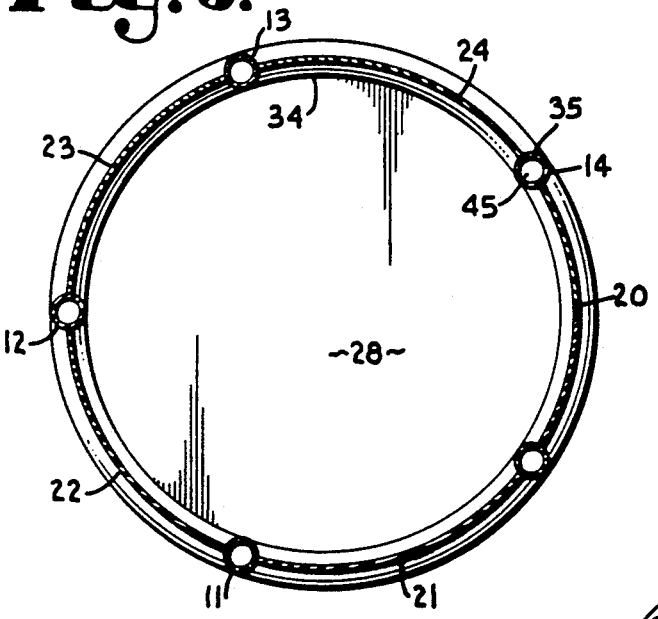
FIG. 5 is a cross-sectional view of the inflatable shelter taken along line 5—5 of FIG. 4.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in detail and particularly to FIGS. 1 through 5, a first embodiment of an inflatable shelter according to this invention, generally designated by the reference numeral 1, includes: an annular, tubular base frame 5; inflatable support means such as tubular support ribs 10, 11, 12, 13 and 14; wall covering means such as wall portions 20, 21, 22, 23 and 24; a floor 28; and an inflatable mattress 29. A door 30 is located in wall portion 20 and windows 32 and 33 are located in wall portions 22 and 23 respectively.

The tubular base frame 5 is circular when inflated, providing a fixed, annular, peripheral foundation for the inflatable shelter 1. It is forseen that the base frame 5 may be constructed to be eliptical in shape when inflated. Square, rectangular, and other polygonal base frame forms can also be employed but may not be as desirable as circular or eliptical shapes because of the added expense in forming such shapes and also the expense of reinforcing the frame at each angle of the polygon so that the base frame does not shift angularly after inflation.

Figure 6:
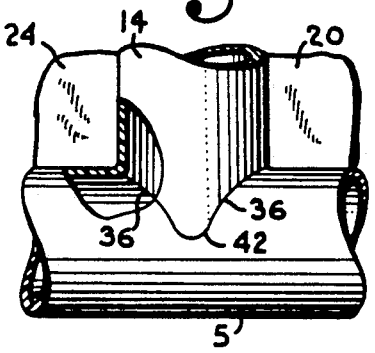
FIG. 6 is an enlarged, fragmentary, front elevational view of the inflatable base frame and a connecting inflatable wall support rib with a portion broken away to show detail thereof.

Tubular support ribs 10, 11, 12, 13 and 14 are each sewn, heat-sealed or otherwise fixedly attached at equidistant locations around a circumference 34 of the base frame 5. The base frame 5 and the support ribs 10, 11, 12, 13 and 14 can be made from a strong, flexible, air impervious plastic material such as polyvinyl chloride and of a thickness sufficient to retain flexibility when deflated but also withstand adequate air pressure when inflated and have resistance to puncture. Each of the tubular support ribs 10, 11, 12, 13 and 14 has an open end 35 having a lower edge 36 configured to mate with the base frame 5 and extend along approximately an upper half 38 of the tube 39 of the base frame 5. As shown in FIG. 6, the lower edge 36 forms generally V-shaped inner 40 and outer 42 support members that maintain each rib 10, 11, 12, 13 and 14 in a semi-rigid position when the shelter is inflated. Generally circular aperatures 45 in the base frame 5 are located within the area defined by the juncture of base frame 5 with the edge 36 of support ribs 10, 11, 12, 13 and 14 creating an inflatable shelter 1 with fluidically connected tubular air chambers or compartments within the base frame 5 and each support rib requiring a single air valve 46 for inflation and deflation located on the base frame 5. Because all the air chambers are fluidically interconnected, it is noted that the air valve 46 may be located at any suitable point on the base frame 5 or support ribs 10, 11, 12, 13 and 14. The valve 46 may include a safety feature for air release if there is a dramatic increase in temperature.

Support ribs 10, 11, 12, 13 and 14 converge toward a centrally located apex 48 of the inflatable shelter 1 and each rib is heat-sealed or otherwise fixedly attached to each adjacent rib. The tubular air chambers within each of the support ribs 10, 11, 12, 13 and 14 are fluidically connected near the apex 48, providing strength and rigidity to the shelter 1 when inflated.

Pie-shaped supporting wall covering portions or panels 20, 21, 22, 23 and 24 are each sewn, heat-sealed or otherwise fixedly attached at the bottom thereof to base frame 5 and sewn, heat-sealed or otherwise fixedly attached at the sides thereof to the tubular support ribs with wall portion 20 connected to support ribs 10 and 14, wall portion 21 connected to ribs 10 and 11, wall portion 22 connected to ribs 11 and 12, wall portion 23 connected to ribs 12 and 13 and wall portion 24 connected to ribs 13 and 14. Wall portions 20, 21, 22, 23 and 24 are made from flexible, water-resistant material. The wall portions may be made from a clear plastic material to allow for passage of light therethrough. Clear wall panels may be desirable if the inflatable shelter is to be used as a greenhouse or other plant shelter. The wall portions may be painted in camouflage fashion if the shelter is to be used as a hunter's blind.

Shelter entrance means such as door 30 is made by cutting a vertical slit 50 and a horizontal slit 52 in wall portion 20 and fixedly attaching zipper closure 54 to slit 50 and zipper closures 55 and 56 to slit 52 on either side of vertical slit 50. Window means such as windows 32 and 33 located in wall portions 22 and 23 respectively are made by cutting out sections of the wall portions and sewing or otherwise fixedly attaching flexible, detachable screens or netting (not shown) to the wall portions.

A flexible, water-resistant floor 28 is sewn, heat-sealed or otherwise fixedly attached to the base frame 5. Both the floor 28 and window screens may be omitted when using the inflatable shelter 1 as a hunter's blind. The floor 28 may also be omitted when using the shelter 1 for protection of plants against frost.

An inflatable mattress 29, as shown in FIG. 1, has an outer tubular section 60 having a diameter smaller than the diameter of base frame 5 and customized to fit within the base frame 5 and to be contiguous thereto. Elongate, connected tubes 62 make up the inner portion of the mattress and are fixedly attached to the outer section 60. In the preferred embodiment, the mattress 29 is detached from the floor 28 and the base frame 5 and therefore has a separate air valve (not shown).

Tie-down means (not shown) may include loops fixedly attached to the base frame 5 at equa-distant locations therearound and corresponding stakes for securing the shelter 1 to the ground. Tie-down loops may also be fixedly attached to support ribs 10, 11, 12, 13 and 14 at a point midway between the base frame 5 and the apex 48 or fixedly attached at apex 48 with tie-down means such as nylon rope passing through each of the loops and staked to the ground.

The shelter 1 may be made in a variety of sizes. In the first embodiment, the diameter of the circular base frame 5 is approximately seven feet with the inner diameters of tubular support ribs 10, 11, 12, 13 and 14 approximately six inches, creating a two-person dome tent when inflated. The shelter may be made much smaller for use as a temporary shelter and frost protection for plant life or much larger if used as a greenhouse or emergency shelter.

The shelter 1 is in a folded, compact, uninflated form for storage and transport. To use, an operator unfolds the shelter 1, spreading the floor 28 on the ground or other surface upon which the shelter 1 is to be erected. The base frame 5 and support ribs 10, 11, 12, 13 and 14 are then inflated by forcing air through valve 46. As air enters the base frame 5 and support ribs 10, 11, 12, 13 and 14, the shelter 1 automatically erects to form a dome shaped structure as shown in FIG. 1. The operator then secures the shelter 1 to the ground by the tie-down means (not shown).

Figure 7:
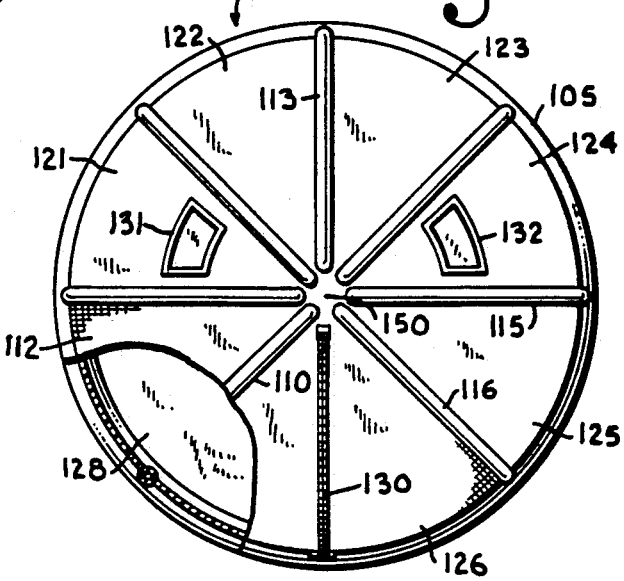
FIG. 7 is a top plan view of a second embodiment of an inflatable shelter in accordance with the present invention, including an inflatable base frame and seven inflatable wall support ribs with a portion broken away to show detail thereof.
Figure 8:
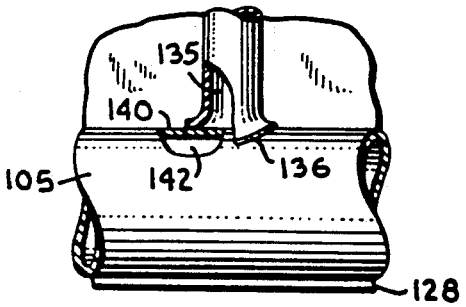
FIG. 8 is an enlarged, fragmentary, front elevational view of the inflatable base frame and an attached inflatable wall support rib of the second embodiment of the inflatable shelter with a portion broken away to show detail thereof.

The second embodiment 100 of the inflatable shelter of this invention, shown in FIGS. 7 and 8, includes a tubular base frame 105, tubular support ribs 110, 111, 112, 113, 114, 115, 116, wall portions 120, 121, 122, 123, 124, 125 and 126, floor 128, inflatable mattress (not shown), door 130, windows 131 and 132 and tie-down means (not shown) made from identical materials and cooperating identically as the respective base frame 5, tubular support ribs 10, 11, 12, 13 and 14, floor 23, inflatable mattress 29, door 30, windows 31 and 32 and tie-down means (not shown) of the first embodiment 1 of the invention with the following exceptions: support ribs 110, 111, 112, 113, 114, 115 and 116 are proportionally smaller in diameter than support ribs 10, 11, 12, 13 and 14 because seven support ribs are utilized rather than five used in the first embodiment 1. Furthermore, each support rib 110, 111, 112, 113, 114, 115 and 116 contains a separate or discrete air compartment 135. The lower edge 136 of each support rib is sewn, heat-sealed or otherwise attached to base frame 105 in a manner similar to the attachment of edge 36 to base frame 5 in the first embodiment 1. However, the wall 140 of base frame 105 fluidically isolates air compartments 135 from the tubular air chamber 142 within base frame 105, as shown in FIG. 8. Support ribs 110, 111, 112, 113, 114, 115 and 116 converge toward a centrally located apex 148, but each rib includes a closed end 150 obstructing any fluid flow therebetween. The base frame 105 and each support rib 110, 111, 112, 113, 114, 115 and 116 each include an air valve (not shown) for inflation and deflation, protecting the shelter 100 from collapse if the base frame 105 or a single rib is punctured.

The shelter 100 is also in a folded, compact, uninflated form for storage and transport. To use, an operator unfolds the shelter 100, spreading the floor 128 on the ground or other surface upon which the shelter 100 is to be erected. The base frame 105 is then inflated by forcing air through the base frame air valve (not shown). Each of support ribs 110, 111, 112, 113, 114, 115 and 116 are then inflated by forcing air through each of the respective air valves (not shown) located on each rib.

It is to be understood that while certain forms of the present invention have been illustrated and described herein, it is not to be limited to the specific forms or arrangement of parts described and shown.

What is claimed and desired to be secured by Letters Patent is as follows:

1. A shelter comprising:

(a) a circular floor made from a flexible, water-resistant material and including a perimeter;

(b) an inflatable, annular, cross-sectionally tubular base frame with an inner edge, an outer edge, a base frame top and a base frame bottom, said base frame surrounding said floor and being fixedly attached at said base frame bottom to said floor perimeter;

(c) a plurality of inflatable, arcuate, cross-sectionally tubular support ribs each having a rib inner edge, a rib outer edge, opposite rib side edges, a rib lower end and a rib upper end, each said rib at its lower end being attached to said base frame top and generally centered on said base frame;

(d) said ribs and said base frame comprising a flexible, air-impervious material;

(e) an apex;

(f) said ribs terminating at their upper ends at said apex;

(g) a wall comprising a plurality of flexible, water-resistant wall panels each having opposite side edges, a top and a lower edge, each said side panel being fixedly and integrally connected at its side edges to a respective adjacent pair of support ribs, each said side edge being substantially centered at its connection to a respective rib between said rib inner and outer edges, each said panel bottom edge being fixedly connected to base frame top and said connection therebetween being substantially centered between said base frame inner and outer edges, said wall panel tops being connected to said apex;

(h) a zippered door located in one of said wall covering panels between a respective pair of said support ribs, said apex and said base frame, said door comprising a first slit extending generally from said apex to said base frame and further comprising a horizontal slit extending along said base frame substantially between a respective pair of ribs;

(i) a pair of windows each located in a respective wall covering panel and including a pane of flexible, transparent material and a window frame connecting said window pane to said wall panel;

(j) a mattress including an inflatable annular, cross-sectionally tubular mattress frame with an inner edge, an outer edge, a top and a bottom, said mattress frame being positioned within and retained by said base frame with said mattress frame outer edge frictionally engaging said base frame inner edge and said mattress frame bottom resting on said floor, said mattress further including a plurality of elongated, juxtaposed, inflatable tubes with diameters approximately equal to a diameter of said mattress frame, said inflatable tubes extending across said mattress frame in substantially coplanar relationship with said mattress frame, each said tube including opposite ends fixedly connected to said mattress frame at said mattress frame inner edge, said elongated mattress tubes resting on said floor;

(k) said base frame including an air chamber;

(l) each said support rib having an air chamber;

(m) said mattress having a pneumatically discrete air chamber;

(n) said rib upper ends being fluidically interconnected at said apex and said ribs being fluidically interconnected with said base frame at their lower ends.

2. A shelter comprising:

(a) a circular floor made from a flexible, water-resistant material and including a perimeter;

(b) an inflatable, annular, cross-sectionally tubular base frame with an inner edge, an outer edge, a base frame top and a base frame bottom, said base frame surrounding said floor and being fixedly attached at said base frame bottom to said floor perimeter;

(c) a plurality of inflatable, arcuate, tubular support ribs each having a rib inner edge, a rib outer edge, opposite rib side edges, a rib lower end and a closed rib upper end, each said rib at its lower end being attached to said base frame top and generally centered on said base frame;

(d) said ribs and said base frame comprising a flexible, air-impervious material;

(e) an apex;

(f) said ribs terminating at their closed, upper ends in spaced relation at said apex with said apex being located therebetween;

(g) a wall comprising a plurality of flexible, water-resistant wall panels each having opposite side edges, a top and a lower edge, each said wall panel being fixedly and integrally connected at its side edges to a respective adjacent pair of support ribs, each said side edge being substantially centered at its connection to a respective rib between said rib inner and outer edges, each said panel bottom edge being fixedly connected to base frame top with said connection therebetween being substantially centered between said base frame inner and outer edges, said wall panel tops being connected to said apex;

(h) a zippered door located in one of said wall covering panels between a respective pair of said support ribs, said apex and said base frame, said door comprising a first slit extending generally from said apex to said base frame and further comprising a horizontal slit extending along said base frame substantially between a respective pair of ribs.

(i) a pair of windows each located in a respective wall covering panel and including a pane of flexible, transparent material and a window frame connecting said window pane to said wall panel;

(j) a mattress including an inflatable annular, cross-sectionally outer tubular mattress frame with an inner edge, an outer edge, a top and a bottom, said mattress frame being positioned within said base frame with said mattress frame outer edge frictionally engaging and retained by said base frame inner edge and said mattress frame bottom resting on said floor, said mattress further including a plurality of elongated, juxtaposed, inflatable tubes with diameters approximately equal to a diameter of said mattress frame, said inflatable tubes extending across said mattress frame in substantially coplanar relationship with said mattress frame, each said tube including opposite ends fixedly connected to said mattress frame at said mattress frame inner edge, said elongated mattress tubes resting on said floor;

(k) said base frame including a pneumatically discrete air chamber;

(l) each said support rib having a pneumatically discreet air chamber; and (m) said mattress having a pneumatically discreet air chamber.

* * * * *